US007585056B2

(12) United States Patent
Oikawa

(10) Patent No.: US 7,585,056 B2
(45) **Date of Patent: *Sep. 8, 2009**

(54) LIQUID DISCHARGE HEAD

(75) Inventor: Masaki Oikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/103,991

(22) Filed: Apr. 16, 2008

(65) Prior Publication Data

US 2008/0225086 A1 Sep. 18, 2008

Related U.S. Application Data

(62) Division of application No. 11/304,815, filed on Dec. 16, 2005, now Pat. No. 7,387,371.

(30) Foreign Application Priority Data

Dec. 24, 2004 (JP) ..... 2004-373886

(51) Int. Cl.
*B41J 2/05* (2006.01)

(52) U.S. Cl. ..... 347/65; 347/62

(58) Field of Classification Search ..... 347/62, 347/65

See application file for complete search history.

(56) References Cited

U.S. PATENT DOCUMENTS 5,218,376 A 6/1993 Asai
6,155,673 A 12/2000 Nakajima et al.
6,224,191 B1 5/2001 Saito et al.
6,488,364 B1 12/2002 Nakajima et al.
6,652,079 B2 11/2003 Tsuchii et al.
6,830,317 B2 12/2004 Tsuchii et al.
6,976,748 B2 12/2005 Yabe et al.
6,984,025 B2 1/2006 Kaneko et al.
6,988,786 B2 1/2006 Kaneko et al.
7,036,909 B2 * 5/2006 Kubota et al. ..... 347/47
7,077,503 B2 7/2006 Kaneko et al.
7,172,264 B2 2/2007 Kaneko et al.
7,387,371 B2 * 6/2008 Oikawa ..... 347/65
2003/0016270 A1 1/2003 Kubota et al.

FOREIGN PATENT DOCUMENTS

JP 4-10941 1/1992

* cited by examiner

*Primary Examiner*—An H Do
(74) *Attorney, Agent, or Firm*—Fitzpatrick, Cella, Harper & Scinto

(57) ABSTRACT

An ink jet recording head can, when a smaller liquid droplet is obtained, suppress or reduce stagnation of liquid in a second discharge port portion, prevent an offset meniscus in a discharge port, reduce unstable satellite(s) and realize stable discharging with less image deterioration and less floating mist. Two heaters are provided for each bubble generating chamber and the heaters are arranged substantially symmetrically with respect to a center or a center of gravity of a second discharge port portion. In a plan view viewed from a direction perpendicular to a main surface of an element substrate, at least one of two heaters is positioned to straddle an inner area of the second discharge port portion and an outer area outside of the second discharge port portion at a region where the bubble generating chamber is communicated with the liquid supply path.

5 Claims, 9 Drawing Sheets

LIQUID DISCHARGE HEAD

This application is a divisional of U.S. patent application Ser. No. 11/304,815, filed on Dec. 16, 2005, and which issued as U.S. Pat. No. 7,387,371, on Jun. 17, 2008.

BACKGROUND OF THE INVENTION

1. Field of the Invention

The present invention relates to a liquid discharge head for discharging liquid, and more particularly, it relates to an ink jet recording head for performing the recording on a recording medium by discharging ink using an ink jet system.

2. Related Background Art

Regarding ink jet recording methods and recording heads, as disclosed in Japanese Patent Application Laid-open No. H04-010941 (1992), it is known to propose a technique in which a bubble generated by driving an electrothermal transducing element in response to a recording signal is communicated with the atmosphere. In this ink jet recording method, by stabilizing the volume of a flying ink droplet, a small amount ink droplet can be discharged at a high speed. Further, by eliminating cavitation generated during extinguishing the bubble, endurance of a heater can be enhanced. In the above-mentioned patent document, as an example of a design for communicating the bubble with the atmosphere, an arrangement in which a shortest distance between the electrothermal transducing element for generating the bubble in the ink and a discharge port as an opening through which the ink is discharged is greatly shortened in comparison with the prior art is proposed.

Now, the arrangement of the recording head of this type will be described. The recording head of this type comprises an element substrate on which the electrothermal transducing elements for causing the ink to be discharged are provided, and a flow path constituting substrate joined to the element substrate to form ink flow paths. The flow path constituting substrate defines a plurality of nozzles through which the ink flows, supply chambers for supplying the ink to the respective nozzles, and a plurality of discharge ports as nozzle tip end openings for discharging an ink droplet. The nozzle includes a bubble generating chamber within which the bubble is generated by the electrothermal transducing element, and a supply path for supplying the ink to the bubble generating chamber. On the element substrate, the electrothermal transducing elements are provided to be disposed in the respective bubble generating chambers. Further, in the element substrate, a supply port is provided for supplying the ink to the supply chambers from a back surface side opposite to a main surface of the element substrate which is contacted with the flow path constituting substrate. Further, the discharge ports are provided in a confronting relationship to the respective electrothermal transducing elements on the element substrate.

Further, in the recording head so designed, the ink supplied from the supply port to the supply chambers is supplied along the nozzles and is loaded within the bubble generating chambers. The ink loaded in the bubble generating chamber is discharged as an ink droplet in a direction substantially perpendicular to the main surface of the element substrate by the bubble generated by film boiling of the ink caused by the electrothermal transducing element.

By the way, in the above-mentioned recording head, when the ink droplet is discharged, the ink loaded in the bubble generating chamber is divided into a flow toward a discharge port side and a flow toward a supply path side by the bubble growing within the bubble generating chamber. In this case, pressure generated by the bubbling of the fluid may escape toward the supply path side or may be partially lost by the friction against an inner wall of the discharge port.

This phenomenon adversely influences the discharging and tends to become noticeable as the liquid droplet to be discharged becomes smaller. That is to say, if a diameter of the discharge port is reduced to form a smaller size liquid droplet, the resistance of the discharge port portion is greatly increased, and thus, since the flow rate toward the discharge port direction is increased and the flow rate toward the flow path direction is decreased, the discharging speed of the ink droplet is decreased.

In order to solve this problem, U.S. Patent Publication No. 2003-0016270 proposes a head as shown in FIGS. 9A to 9C. FIG. 9A is a plan view of the recording head, viewed from a direction perpendicular to a substrate, FIG. 9B is a sectional view taken along the line 9B-9B in FIG. 9A and FIG. 9C is a sectional view taken along the line 9C-9C in FIG. 9A.

The ink jet recording head shown in FIGS. 9A to 9C comprises a plurality of nozzles through which ink flows, supply chambers 106 for supplying ink to the respective nozzles, and a plurality of discharge ports 104 as nozzle tip end openings for discharging the ink droplet. The recording head is provided with a flow path constituting substrate, and an element substrate on which heaters as electrothermal transducing elements are provided and which has a main surface to which the flow path constituting substrate is joined. The flow path constituting substrate includes first discharge port portions including first discharge ports 104, bubbling chambers 111 within each of which a bubble is generated by the heater 101, second discharge port portions 110 communicating between the respective first discharge port portion 104 and the respective bubbling chamber 111, and supply paths 109 for supplying the ink to the respective bubbling chambers 111. The second discharge port portion 110 is a cylindrical or frusto-conical space centered on a vertical line extending from the center of the first discharge port portion 104 to the element substrate vertically and is communicated with the corresponding first discharge port portion 104 and the corresponding bubbling chamber 111. Further, in the plan view viewed from the direction perpendicular to the main surface of the element substrate, when looking at the direction perpendicular to the main surface of the element substrate, an outer periphery of the second discharge port portion 110 is positioned outside an outer periphery of the first discharge port portion 104 and is positioned inside an outer periphery of the bubbling chamber 111.

In the recording head having the above-mentioned construction, by providing the second discharge port portion 110 having a cross-sectional area greater than that of the first discharge port portion 104 in a direction perpendicular to an ink flowing direction, the total flow resistance of the ink flow flowing toward the discharge port 104 is reduced. Thus, since the bubble generated by the bubble generating action is growing toward the discharge port 104 with less pressure loss, the flow rate of the ink escaping toward the flow path can be suppressed and, thus, the reduction of the discharging speed of the ink droplet can be prevented.

However, if one tries to further reduce the dimension of the discharge liquid droplet, the diameter of the discharge port must be further decreased and, thus, the flow resistance toward the direction of the discharge port must be further decreased in comparison with the recording head having the above-mentioned second discharge port portion. To this end, the cross-sectional area of the second discharge port portion must be increased; in this case, however, when the bubble is generated in the ink by driving the heater, the ink is apt to be stagnated. As a result, the ink supplied from the supply path flows into the second discharge port portion and a meniscus in the discharge port is offset, with the result that the speed of the firstly flying main droplet becomes very slow and smaller diameter liquid droplets (satellite droplets) are discharged subsequently (refer to FIG. 5H).

Such satellite droplets may deteriorate an image if they are adhered to the recording medium and, if the satellite droplets do not reach the recording medium, they will constitute floating ink mist which may be adhered to various elements of a recording apparatus (printer) to contaminate the latter.

Further, other than the satellite droplets, when the main droplet is flying, due to the offset of the meniscus, the main droplet itself flies unstably, thereby deteriorating the recorded image.

Furthermore, when the discharging is performed continuously at high frequency, the stagnation of the ink in the second discharge port portion may cause dispersion in discharging volume due to heat accumulated in the ink.

SUMMARY OF THE INVENTION

The present invention is made in consideration of the above-mentioned problems. The present invention can provide a liquid discharge head which, when a smaller liquid droplet is obtained, can suppress or reduce stagnation of liquid in a second discharge port portion, prevent an offset meniscus in a discharge port, reduce unstable satellite(s) and realize stable discharging with less image deterioration and less floating mist. Further, the present invention can provide a liquid discharge head which can suppress dispersion in discharging volume due to heat accumulated in the liquid as mentioned above.

A liquid discharge head according to the present invention can comprise an element substrate having a main surface on which a plurality of discharge energy generating elements for generating energy for discharging a liquid droplet are provided, and a flow path constituting substrate joined to the main surface of the element substrate in order to constitute a bubble generating chamber having the plurality of discharge energy generating elements, a first discharge port portion for discharging the liquid droplet, a second discharge port portion for communicating the bubble generating chamber with the first discharge port portion and a liquid supply path for supplying the liquid to the bubble generating chamber, and is characterized in that the plurality of discharge energy generating elements are arranged substantially symmetrically with respect to a center or a center of gravity of the second discharge port portion and that at least one of the discharge energy generating elements is disposed to straddle between an inner area of the second discharge port portion and an outer area outside of the second discharge port portion in a plan view viewed from a direction perpendicular to the main surface of the element substrate.

According to the liquid discharge head of the present invention, when the smaller liquid droplet is obtained, stagnation of ink in the second discharge port portion can be reduced, and an offset meniscus in the discharge port can be prevented, and unstable satellite(s) can be reduced and stable discharging with less image deterioration and less floating mist can be realized.

DESCRIPTION OF THE PREFERRED EMBODIMENTS

Now, embodiments of the present invention will be explained with reference to the accompanying drawings.

[Brief Explanation of Entire Apparatus]

Figure 1:
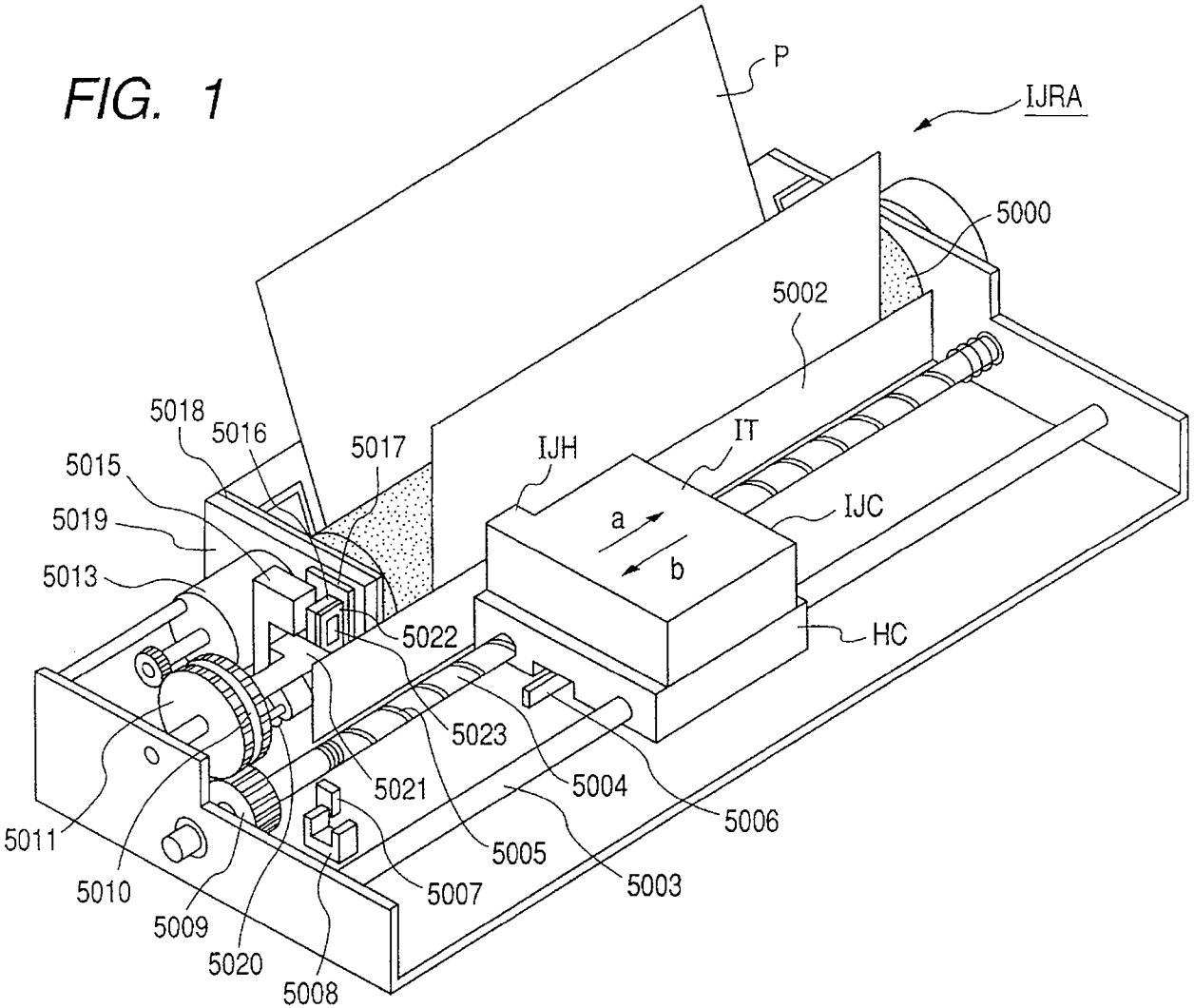
FIG. 1 is a perspective view showing a schematic construction of an ink jet printer IJRA according to a representative embodiment of the present invention.

FIG. 1 is a perspective view showing a schematic construction of an ink jet printer IJRA according a representative embodiment of the present invention. In FIG. 1, a carriage HC is engaged by a helical groove 5005 of a lead screw 5004 rotated via driving force transmitting gears 5009 to 5011 synchronously with a normal rotation of a drive motor 5013 and has a pin (not shown). The carriage HC is supported by a guide rail 5003 and is reciprocally shifted in directions shown by the arrows a and b.

An ink jet cartridge IJC of integral type including a recording head IJH and an ink tank IT is mounted on the carriage HC. A paper hold-down plate 5002 serves to urge a recording paper P against a platen 5000 along a shifting direction of the carriage HC. A photo-coupler 5007, 5008 is a home position detector for detecting a lever 5006 of the carriage at this area and for switching a rotational direction of the motor 5013. A member 5016 serves to support a cap member 5022 for capping a front surface of the recording head IJH. A sucking device 5015 for performing suction within the cap serves to perform suction recovery of the recording head via a cap opening 5023. A cleaning blade 5017 and a member 5019 capable of shifting the blade in a front-and-rear direction are supported by a main body support plate 5018. It should be noted that the blade is not limited to the illustrated cleaning blade, but any well-known cleaning blade can be applied to the illustrated embodiment. Further, a lever 5021 for initiating suction of the suction recovery is shifted synchronously with a shifting movement of a cam 5020 engaged by the carriage, and a driving force from the drive motor is controlled by a well-known transmitting mechanism such as a clutch switching mechanism.

It is designed so that the capping, cleaning and suction recovery are performed at their corresponding positions by the action of the lead screw 5004 when the carriage reaches the home position area.

[Explanation of Control Arrangement]

Next, a control arrangement for carrying out recording control of the above-mentioned apparatus will be described.

Figure 2:
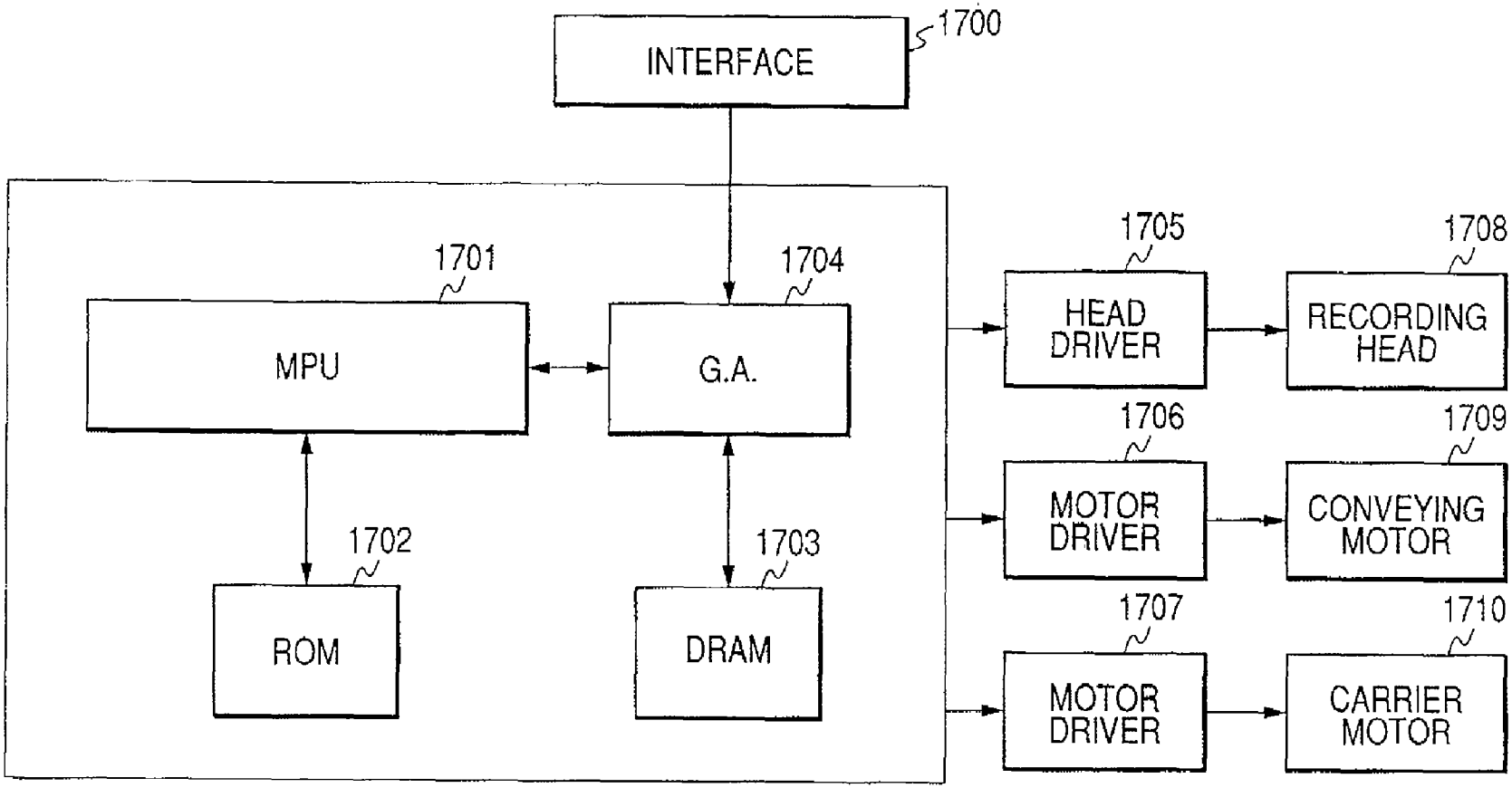
FIG. 2 is a block diagram showing a construction of a control circuit of the ink jet printer IJRA.

FIG. 2 is a block diagram showing a construction of a control circuit of the ink jet printer IJRA.

In FIG. 2 showing the control circuit, the control circuit includes an interface 1700 for inputting a recording signal, an MPU 1701 and a ROM 1702 for storing a control program which is carried out by the MPU 1701. Further, the control circuit also includes a DRAM 1703 for reserving various data (the recording signal, recording data supplied to the recording head IJH and the like). A gate array (G.A.) 1704 for controlling the supplying of the recording data to the recording head IJH also serves to control the transferring of data between the interface 1700, MPU 1701 and RAM 1703. The control circuit further includes a carrier motor 1710 for conveying the recording head IJH, a conveying motor 1709 for conveying the recording paper, a head driver 1705 for driving the recording head IJH and motor drivers 1706 and 1707 for driving the conveying motor 1709 and the carriage motor 1710, respectively.

Explaining an operation of the above-mentioned control arrangement, when the recording signal is inputted to the interface 1700, the recording signal is converted into a printing recording data between the gate array 1704 and the MPU 1701. Then, the motor drivers 1706 and 1707 are driven and the recording head IJH is driven in accordance with the recording data sent to the head driver 1705, thereby performing the recording.

Next, the ink jet recording head IJH according to the illustrated embodiment will be explained. The ink jet recording head according to the illustrated embodiment is a recording head of the type which includes means for generating thermal energy as energy utilized to discharge liquid ink and in which change in condition of the ink is created by the thermal energy. By using this type, high density and high minuteness of a character and an image to be recorded can be achieved. Particularly, in the illustrated embodiment, an electrothermal transducing element is used as the means for generating the thermal energy, and the ink is discharged by utilizing pressure of a bubble generated when film boiling is caused by heating the ink by means of the electrothermal transducing element.

Figure 3:
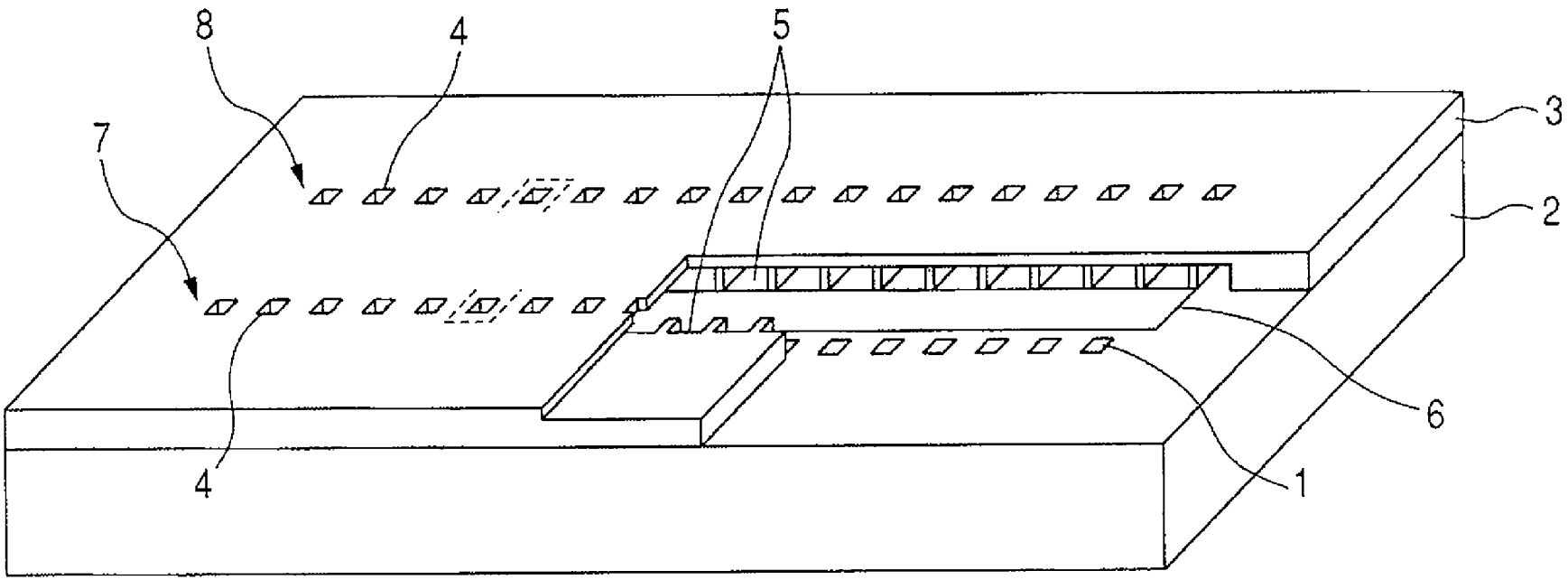
FIG. 3 is a partial fragmental perspective view showing an embodiment of an ink jet recording head suitable for the present invention.

First of all, an entire construction of the ink jet recording head according to the illustrated embodiment will be described. FIG. 3 is a partial fragmental perspective view showing the embodiment of the ink jet recording head suitable for the present invention.

The ink jet recording head according to the embodiment shown in FIG. 3 is designed so that isolating walls for forming nozzles 5 as ink flow paths separately and independently for each of plural heaters as electrothermal transducing elements extend from discharge port portions 4 to the neighborhood of a supply chamber 6.

The ink jet recording head includes an element substrate 2 on which the plurality of heaters 1 and the plurality of nozzles 5 are formed. There are provided a first nozzle array 7 in which longitudinal directions of the respective nozzles are arranged in parallel, and a second nozzle array 8 in which longitudinal directions of the respective nozzles are arranged in parallel at a position opposed to the position of the first nozzle array 7 with the interposition of the supply chamber 6.

In each of the first and second nozzle arrays 7 and 8, a distance between the adjacent nozzles (pitch) is selected to be 600 dpi. Further, each nozzle 5 in the second nozzle array 8 is disposed so that the pitch between the adjacent nozzles is diverged by 1/2 pitch with respect to each nozzle 5 in the first nozzle array 7.

Such a recording head includes ink discharge means to which the ink jet recording method disclosed in the above-mentioned Japanese Patent Application Laid-open No. H04-010941 is applied, so that a bubble generated during the discharging of the ink is communicated with the atmosphere via the discharge port 4.

Hereinafter, various embodiments of a nozzle structure of the ink jet recording head which constitutes a main portion of the present invention will be explained.

First Embodiment

Figure 4A:
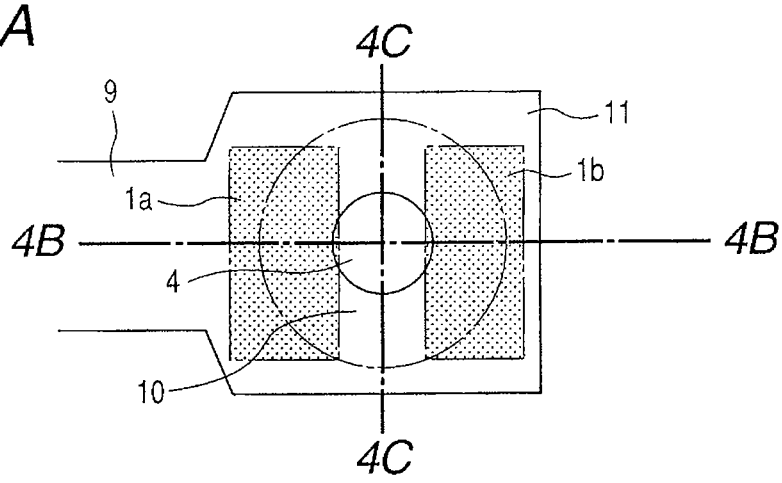
FIGS. 4A, 4B and 4C are views showing a nozzle structure of an ink jet recording head according to a first embodiment of the present invention.
Figure 4B:
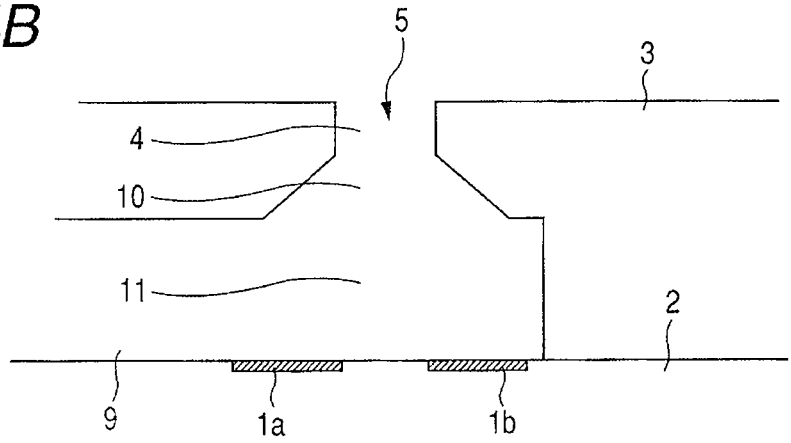
Figure 4C:
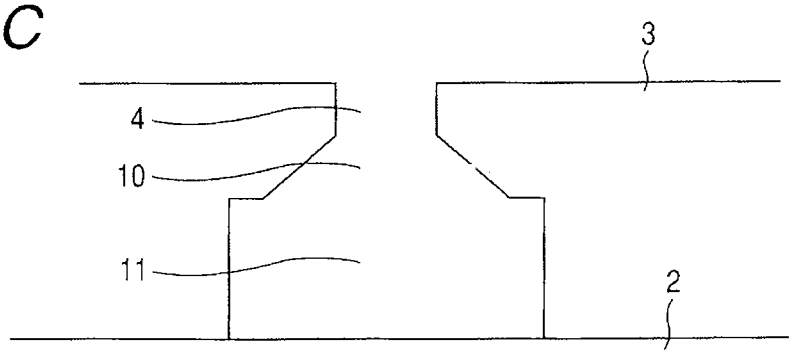

FIGS. 4A to 4C are views showing a nozzle structure of an ink jet recording head according to a first embodiment of the present invention. Here, FIG. 4A is a plan view of one of plural nozzles of the ink jet recording head, viewed from a direction perpendicular to a substrate, FIG. 4B is a sectional view taken along the line 4B-4B in FIG. 4A and FIG. 4C is a sectional view taken along the line 4C-4C in FIG. 4A.

The ink jet recording head according to this embodiment includes an element substrate 2 on which a plurality of heaters 1 as discharge energy generating elements (electrothermal transducing elements) are provided, and a flow path constituting substrate 3 joined to a main surface of the element substrate 2 to define a plurality of ink flow paths.

The element substrate 2 may be formed of, for example, glass, ceramic, resin or metal and is generally formed from silicon (Si). On the main surface of the element substrate 2, for respective ink flow paths, heaters 1, electrodes (not shown) for applying voltage to the respective heaters 1 and wirings (not shown) connected to the respective electrodes are provided in predetermined wiring patterns. Further, an insulation film (not shown) for enhancing dispersion of accumulated heat is provided on the main surface of the element substrate 2 to cover the heaters 1. Further, a protective film (not shown) for providing protection against cavitation generated when a bubble forms and collapses is provided on the main surface of the element substrate to cover the insulation film.

As shown in FIG. 3, the flow path constituting substrate 3 defines the plurality of nozzles 5 through which the ink flows. As shown in FIGS. 4A to 4C, in each nozzle 5, two heaters 1*a* and 1*b* are disposed at a bottom surface thereof. Further, the nozzle 5 includes a bubble generating chamber 11 within which film boiling of the ink is caused to generate a bubble in the ink, and a first discharge port portion 4 as a tip end opening for discharging an ink droplet and having a substantially uniform inner diameter. Further, the nozzle 5 includes a second discharge port portion 10 for communicating the bubble generating chamber 11 with the first discharge port portion 4 to reduce flow resistance therebetween, and an ink supply path 9 for supplying the ink to the bubble generating chamber 11.

Incidentally, the first discharge port portion 4 is formed at a position opposed to the heaters 1*a* and 1*b* on the element substrate 2. Further, the bubble generating chamber 11 has a substantially rectangular bottom surface opposed to an opening face of the first discharge port portion 4.

The ink supply path 9 has one end communicated with the bubble generating chamber and the other end communicated with a supply chamber 6 (refer to FIG. 3). The ink supply path 9 is formed in a straight configuration in which a flow path width thereof is substantially constant from the supply chamber 6 to the bubble generating chamber 11. The second discharge port portion 10 is formed above the bubble generating chamber 11 to have a shape tapered toward the first discharge port portion 4. The nozzle 5 is designed so that a discharging direction along which the ink droplet is flying becomes perpendicular to a flowing direction of the ink flowing in the ink supply path 9.

As shown in the plan view of FIG. 4A, the first discharge port portion 4 having the relatively small diameter and the second discharge port portion 10 having a larger diameter have shapes homologous with each other and have a common centerline extending perpendicular to the main surface of the element substrate 2 and passing through an intersecting point between the line 4B-4B and the line 4C-4C.

Further, as shown in FIGS. 4B and 4C, the second discharge port portion 10 has a frusto-conical shape in which the diameter thereof is gradually decreased in a tapered fashion from the opening face of the bubble generating chamber 11 to the opening face of the first discharge port portion 4.

Further, in order to discharge the liquid droplet stably toward a direction substantially perpendicular to a forming surface (main surface of the element substrate) on which the two heaters 1*a* and 1*b* are formed, when observed in the plan view of FIG. 4A, the two heaters are disposed substantially symmetrically with respect to a center or a center of gravity of the second discharge port portion 10. With this arrangement, the discharging direction of the liquid droplet is balanced. Incidentally, in any section passing through a center of the first discharge port portion 4 and extending in perpendicular to the main surface of the element substrate 2, a side wall of the second discharge port portion 10 is substantially straight. In addition, the opening face at the first discharge port portion (4) side and the opening face at the bubble generating chamber (11) side, of the second discharge port portion 10, are in parallel with the main surface of the element substrate 2.

Further, in the illustrated embodiment, when observed in the plan view of FIG. 4A, each of two heaters 1*a* and 1*b* is arranged on the element substrate 2 so that the heater straddles between an inner area and an outer area of the second discharge port portion 10. Further, each of heaters 1*a* and 1*b* has a length greater than a width of an opening face of the ink supply path 9 along a width-wise direction of such opening face at the bubble generating chamber side.

Next, an operation for discharging the ink droplet from the first discharge port portion 4 by means of the ink jet recording head so constructed will be explained with reference to FIG. 3 and FIGS. 4A to 4C.

First of all, when the ink is supplied into the supply chamber 6, the ink is supplied to the respective nozzles 4 in the first nozzle array 7 and in the second nozzle array 8, respectively. The ink supplied to the nozzles 5 is loaded in the bubble generating chambers 11 through the ink supply paths 9. The ink loaded in the bubble generating chamber 11 is shifted in the direction substantially perpendicular to the main surface of the element substrate 2 and is discharged as the ink droplet flying from the first discharge port portion 4, by the growing pressure of the bubble generated by film boiling caused by the heaters 1*a* and 1*b*. Incidentally, when the ink loaded in the bubble generating chamber 11 is discharged, a part of the ink in the bubble generating chamber 11 is flown toward the ink supply path 9 side by the pressure of the bubble generated in the bubble generating chamber 11. Here, when observing locally states from the bubbling to the discharging of the ink in the nozzle 5, the pressure of the bubble generated in the bubble generating chamber 11 is also transferred to the second discharge port portion 10 immediately, so that the ink loaded in the bubble generating chamber 11 and the second discharge port portion 10 is shifted within the second discharge port portion 10.

Figure 9A:
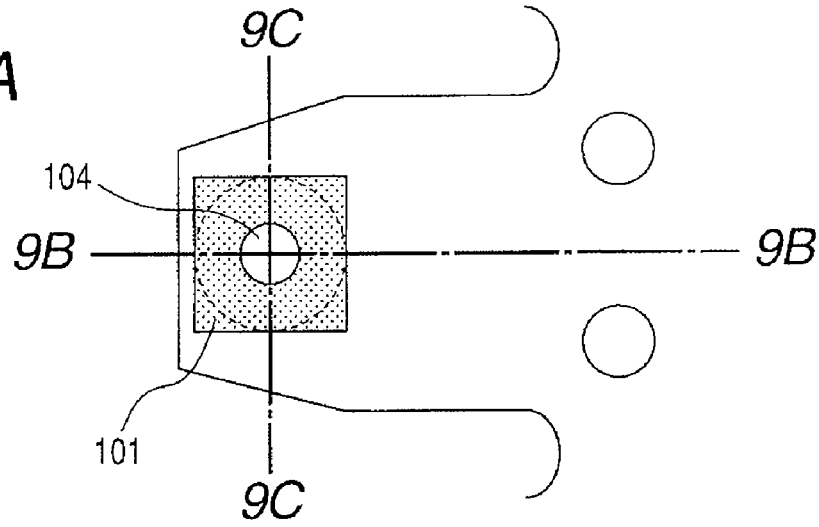
FIGS. 9A, 9B and 9C are views showing one of plural nozzles of a conventional ink jet recording head.
Figure 9B:
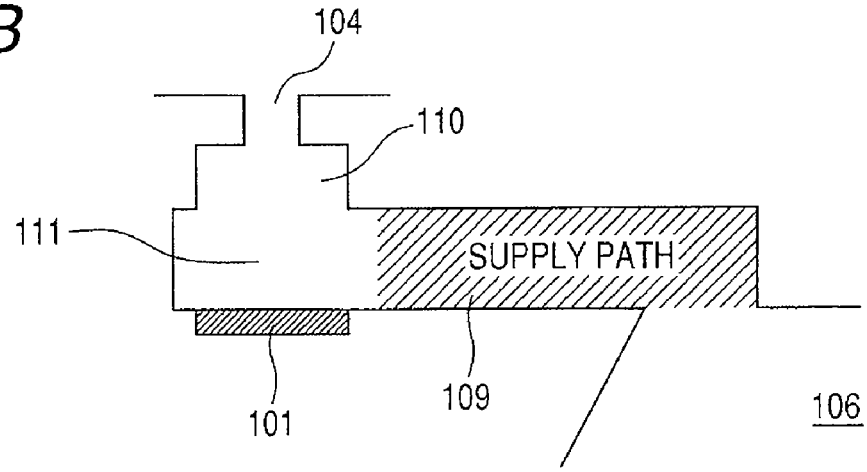
Figure 9C:
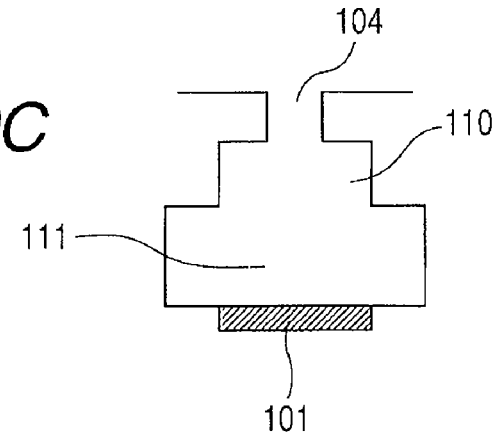

Now, the states from the bubbling to the discharging of the ink in the nozzle will be fully described with reference to schematic views shown in FIGS. 5A to 5H. FIGS. 5A to 5D show an ink discharging operation in the arrangement according to the illustrated embodiment, and FIGS. 5E to 5H show an ink discharging operation in the conventional arrangement (refer to FIGS. 9A to 9C).

Figure 5A:
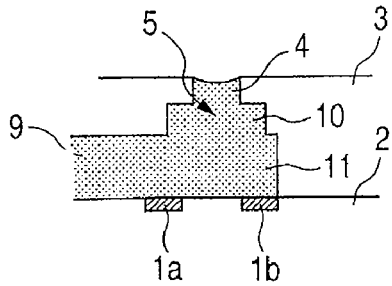
FIGS. 5A, 5B, 5C, 5D, 5E, 5F, 5G and 5H are schematic views for explaining states from bubbling in ink in a nozzle to discharging in detail.
Figure 5B:
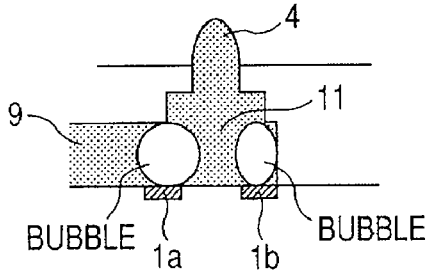

First of all, the ink discharging operation in the arrangement according to the illustrated embodiment will be explained with reference to FIGS. 5A to 5D. FIG. 5A shows a condition that the ink is loaded in the nozzle 5. From this condition, as shown in FIG. 5B, when the two heaters 1*a* and 1*b* are driven simultaneously to heat the ink in the bubble generating chamber 11, the ink starts to be pushed toward the first discharge port portion 4 by the growing pressure of the bubble generated by the film boiling.

Figure 5C:
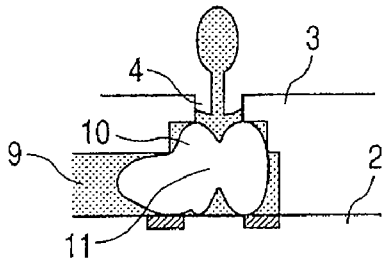

In the arrangement according to the illustrated embodiment, as mentioned above, when observed in the plan view (FIG. 4A), each of the heaters 1*a* and 1*b* is disposed to straddle between the area within the second discharge port portion 10 and the area out of the second discharge port portion. Thus, when the bubbling condition reaches a substantially maximum condition as shown in FIG. 5C, the bubble also pushes the ink existing in a region of the second discharge port portion 10 where the ink may be stagnated (i.e. a region of the second discharge port portion 10 situated out of the inner diameter of the first discharge port portion 4) toward the first discharge port portion 4. Furthermore, the two bubbles generated by the two heaters 1*a* and 1*b* push the ink within the bubble generating chamber 11 toward the first discharge port portion 4 while pinching the ink therebetween.

Figure 5D:
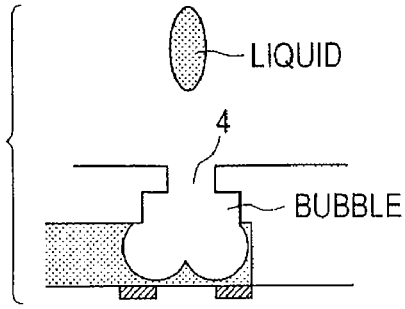

The bubbles generated in this way can separate the ink in the ink supply path 9 from the ink in the bubble generating chamber 11. Thereafter, as shown in FIG. 5D, the bubble is communicated with the atmosphere through the first discharge port portion 4, with the result that the liquid droplet is discharged from the first discharge port portion 4.

According to the illustrated embodiment, as mentioned above, since the ink existing in the region of the second discharge port portion 10 where the ink may be stagnated is also pushed out, discrepancy in volume of the discharged liquid droplet which would be caused due to heat accumulated in the ink stagnated in the second discharge port portion 10 can be suppressed. Further, since the ink in the ink supply path 9 is separated from the ink in the bubble generating chamber 11, satellite(s) and/or ink mist which would occur after the main liquid droplet can be reduced. Thus, the liquid droplet can be discharged stably, thereby enhancing the quality of the recorded image. In the arrangement according to the illustrated embodiment, by adjusting the bubbling power obtained by the two heaters 1*a* and 1*b* appropriately, occurrence of the satellite(s) and/or the mist can be eliminated.

Further, in the illustrated embodiment, by arranging the heaters 1*a* and 1*b* as mentioned above, the ink existing in the region of the second discharge port portion 10 where the ink may be stagnated can be pushed out and the ink in the ink supply path 9 can be separated from the ink in the bubble generating chamber 11. Thus, dimensions of the discharge port portions 4 and 10 and the like are not required to be set or selected specially in order to prevent the stagnation of the ink in the second discharge port portion 10 and to separate the ink in the ink supply path 9 from the ink in the bubble generating chamber 11. Speaking conversely, this means that a degree of freedom of design regarding the dimensions of the discharge port portions 4 and 10 and the like is increased.

Further, in the illustrated embodiment, by arranging the heaters 1*a* and 1*b* as mentioned above, the ink in the ink supply path 9 is separated from the ink in the bubble generating chamber 11. Thus, even if there is discrepancy in dimensions of various parts of the second discharge port portion 10 more or less, the ink in the ink supply path 9 can be separated from the ink in the bubble generating chamber 11. Accordingly, during the manufacture, even if there is dispersion in the dimension of the second discharge port portion 10 itself and/or in alignment of the second discharge port portion 10 with respect to the ink supply path 9 more or less, such dispersion does almost not affect an influence upon the discharging of the liquid droplet. According to the illustrated arrangement, since the above-mentioned dispersion can be allowed, a manufacturing cost of the ink jet recording head can be reduced.

Figure 5E:
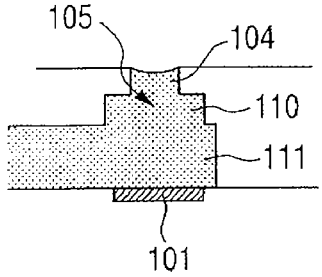
Figure 5F:
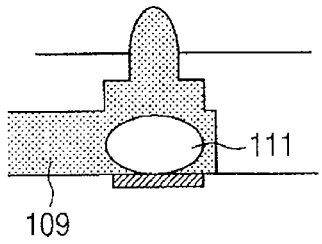

To the contrary, in the conventional arrangement, as shown in FIG. 5E, a heater 101 is disposed just under a center of a second discharge port portion 110. Thus, a bubble generated by film-boiling the ink by means of the heater 101 is growing toward a discharge port 104 and an ink supply path 109 to which the pressure is apt to escape (refer to FIG. 5F).

Figure 5G:
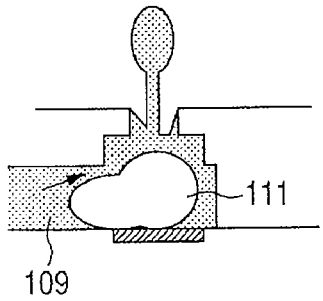
Figure 5H:
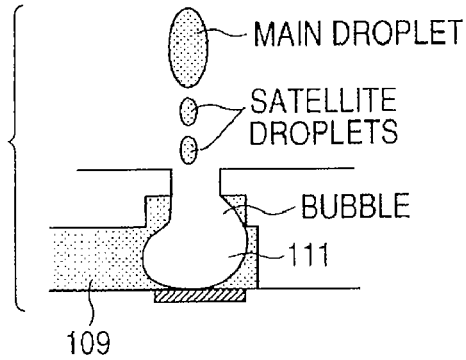

Thus, as shown in FIG. 5G, the generated bubble is growing asymmetrically with respect to a centerline of a nozzle 105, with the result that, as shown by the arrow in FIG. 5G, the ink in an ink supply path 109 is difficult to be separated from the ink in a bubble generating chamber 111. If the liquid droplet is discharged in a condition that the ink in the ink supply path 109 is connected to the ink in the bubble generating chamber 111, offset meniscus surfaces may be formed in the discharge ports 104 and 110 by the ink refilled from the ink supply path 109 to the bubble generating chamber 111. In this case, the ink remaining in the discharge ports 104 and 110 in the offset condition is discharged from the discharge port 104 while being entrained by the main liquid droplet, with the result that satellite(s) having smaller diameter and less discharging speed and/or ink mist may be generated.

Second Embodiment

Figure 6A:
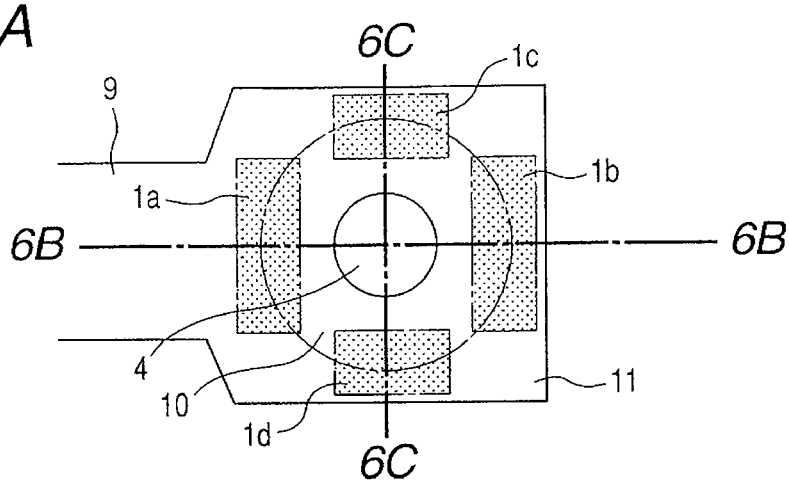
FIGS. 6A, 6B and 6C are views showing a nozzle structure of an ink jet recording head according to a second embodiment of the present invention.
Figure 6B:
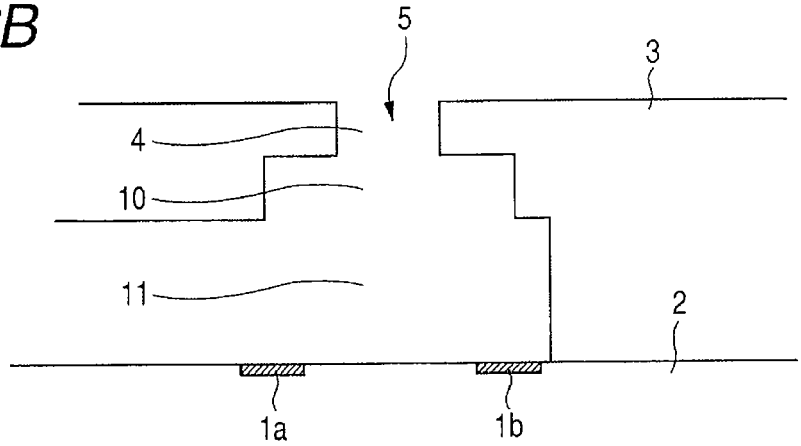
Figure 6C:
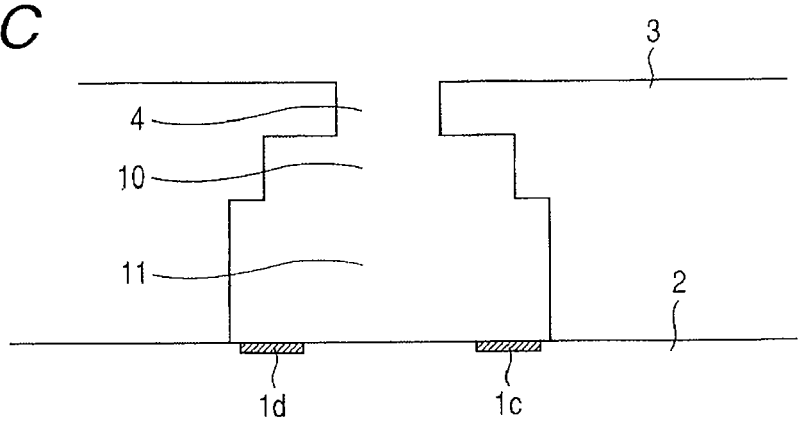

FIGS. 6A to 6C are views showing a nozzle structure of an ink jet recording head according to a second embodiment of the present invention. Here, FIG. 6A is a plan view of one of plural nozzles of the ink jet recording head, viewed from a direction perpendicular to a substrate, FIG. 6B is a sectional view taken along the line 6B-6B in FIG. 6A and FIG. 6C is a sectional view taken along the line 6C-6C in FIG. 6A.

As shown in FIGS. 6A to 6C, in this embodiment, each nozzle 5 includes four heaters 1*a*, 1*b*, 1*c* and 1*d*. When observed in the plan view shown in FIG. 6A, these four heaters 1*a*, 1*b*, 1*c* and 1*d* are disposed substantially symmetrically with respect to a center or a center of gravity of the second discharge port portion 10, thereby balancing the discharging direction of the liquid droplet. Further, an area of each of two heaters 1*a* and 1*b* shown in FIG. 6A and arranged on the line 6B-6B extending along the ink supply path 9 is greater than an area of each of two heaters 1*c* and 1*d* arranged on the line 6C-6C perpendicular to the line 6B-6B. Further, similar to the first embodiment, when observed in the plan view shown in FIG. 6A, all of the heaters 1*a*, 1*b*, 1*c* and 1*d* are arranged on the element substrate 2 in such a manner that each heater straddles between the inner area within the second discharge port portion 10 and the outer area out of the second discharge port portion.

In the illustrated embodiment, as shown in FIG. 6B, the second discharge port portion 10 has a cylindrical shape. Thus, a volume of the second discharge port portion 10 according to the illustrated embodiment is greater than the volume of the second discharge port portion 10 having the tapered side wall as shown in FIG. 4B. In such an arrangement in which the volumes of the second discharge port portion 10 and the bubble generating chamber 11 are great, if only two heaters are provided for each nozzle 5 as is in the first embodiment, volumes of the bubbles generated by the bubbling action become smaller relatively with respect to the volumes of the second discharge port portion and the bubble generating chamber. As a result, as explained with reference to FIG. 5G, while the bubble is being grown, the ink in the bubble generating chamber 11 may not be separated from the ink in the ink supply path 9 by the bubble.

To the contrary, in the case where the four heaters 1*a*, 1*b*, 1*c* and 1*d* are provided for each nozzle 5 as in the illustrated embodiment, even when the volumes of the second discharge port portion 10 and the bubble generating chamber 11 are great as in the illustrated embodiment, the volume of the bubble generated by these heaters becomes relatively large. Thus, while the bubble is being grown, the ink in the bubble generating chamber 11 can positively be separated from the ink in the ink supply path 9 by the bubble.

Third Embodiment

Figure 7A:
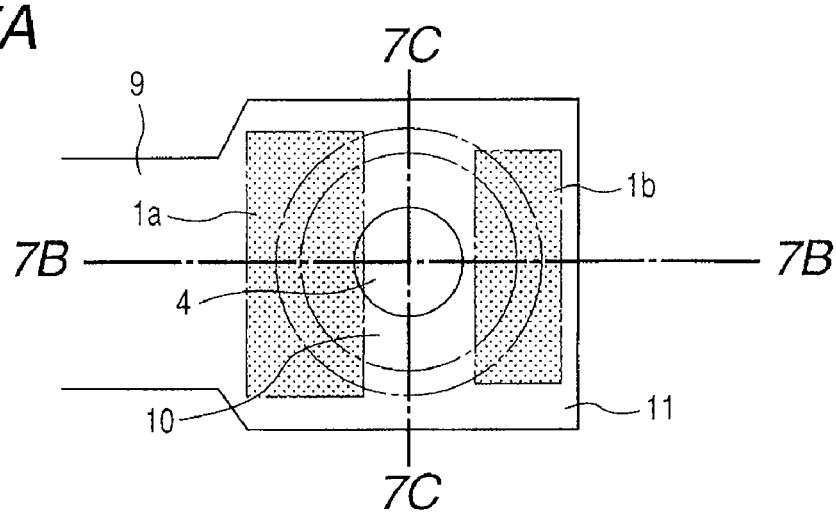
FIGS. 7A, 7B and 7C are views showing a nozzle structure of an ink jet recording head according to a third embodiment of the present invention.
Figure 7B:
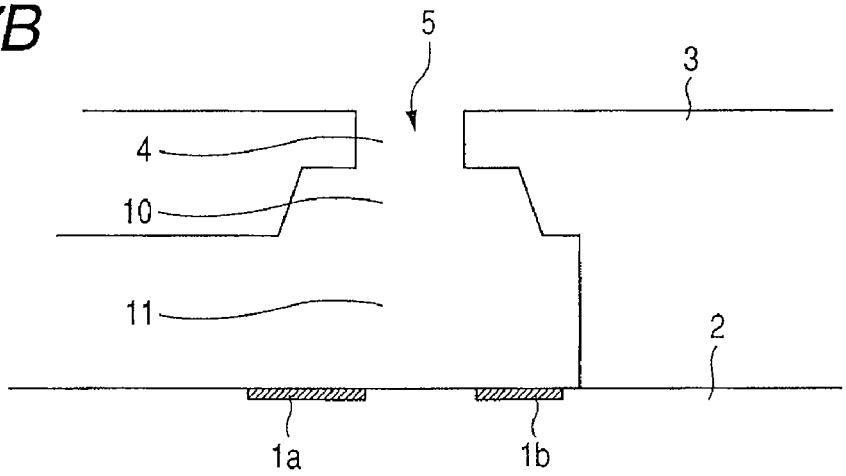
Figure 7C:
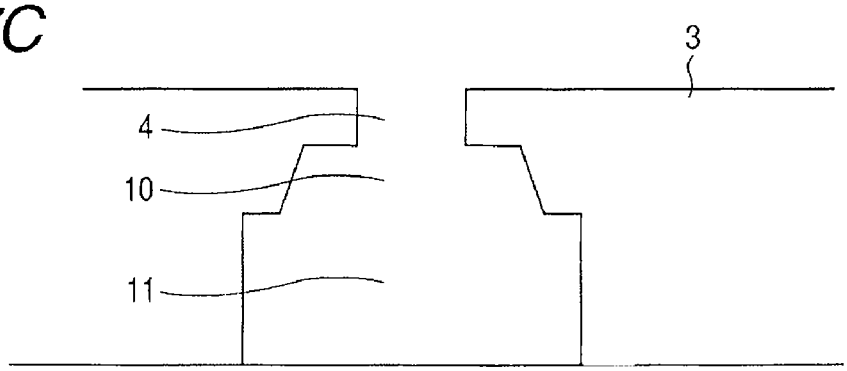

FIGS. 7A to 7C are views showing a nozzle structure of an ink jet recording head according to a third embodiment of the present invention. Here, FIG. 7A is a plan view of one of plural nozzles of the ink jet recording head, viewed from a direction perpendicular to a substrate, FIG. 7B is a sectional view taken along the line 7B-7B in FIG. 7A and FIG. 7C is a sectional view taken along the line 7C-7C in FIG. 7A.

As shown in FIGS. 7A to 7C, also in this embodiment, similar to the first embodiment, two heaters 1*a* and 1*b* are provided for each nozzle 5, and these heaters 1*a* and 1*b* are arranged on the line 7B-7B extending along the ink supply path 9. However, in this third embodiment, among two heaters 1*a* and 1*b*, a volume of the heater 1*a* positioned nearer to the ink supply path 9 is greater than a volume of the other heater 1*b*. Further, in this embodiment, in comparison with the first embodiment, the ink supply path 9 is wider so that the ink flow resistance in the ink supply path 9 becomes smaller. Further, since a diameter of an upper part of the second discharge port portion 10 is greater than that of the second discharge port portion in the first embodiment, a volume of the second discharge port portion 10 is greater than that in the first embodiment.

Incidentally, also in this embodiment, similar to the first embodiment, when observed in the plan view shown in FIG. 7A, each of two heaters 1*a* and 1*b* is arranged on the element substrate 2 so that each heater straddles between the inner area of the second discharge port portion 10 and the outer area out of the second discharge port portion. Further, the heater has a length greater than a width of an opening portion of the ink supply path 9 at the bubble generating chamber side in a width-wise direction of the opening portion.

With this arrangement, if two heaters 1*a* and 1*b* have the same dimension as is in the first embodiment, the bubble generated by the heaters may be growing while being inclined toward the ink supply path 9, with the result that the meniscus surface in the discharge port 4 may be inclined or offset.

To the contrary, as is in this embodiment, in the arrangement in which the heater 1*a* positioned nearer to the ink supply path 9 is greater than the other heater 1*b*, the bubble generating energy of the heater 1*a* positioned nearer to the ink supply path 9 is greater than that of the other heater 1*b*. Thus, a force for trying to grow the bubble generated by the heaters 1*a* and 1*b* toward a direction opposite to the ink supply path 9 is created.

As a result, the force for growing the bubble while inclining it toward the ink supply path 9 is cancelled out by the force for trying to grow the bubble toward the direction opposite to the ink supply path 9, which is created by the fact that the heater 1*a* positioned nearer to the ink supply path 9 is greater than the other heater 1*b*. Consequently, the ink can be discharged from the discharge port 4 straightly.

Of course, also in this embodiment, similar to the first embodiment, the ink existing in the region of the second discharge port portion 10 where the ink may be stagnated is pushed out positively and the ink in the ink supply port 9 can be separated from the ink in the bubble generating chamber 11 positively. Accordingly, the satellite(s) and/or ink mist which may be generated after the main liquid droplet can be reduced.

Fourth Embodiment

Figure 8A:
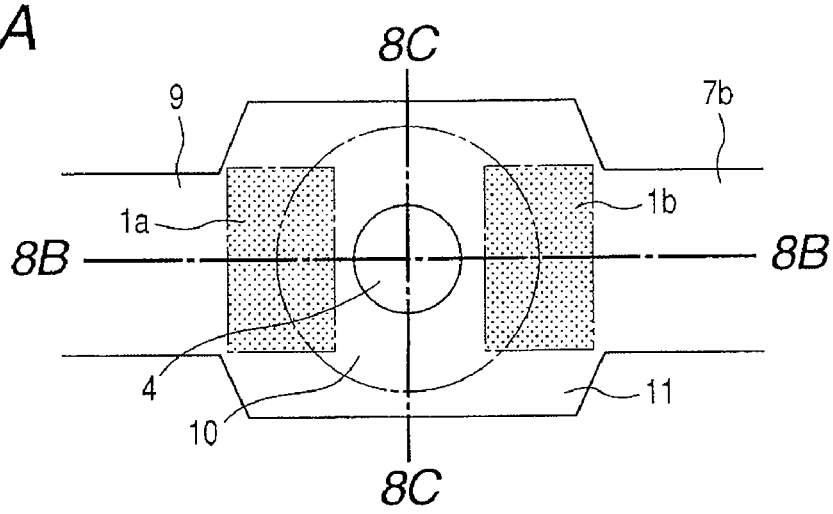
FIGS. 8A, 8B and 8C are views showing a nozzle structure of an ink jet recording head according to a fourth embodiment of the present invention.
Figure 8B:
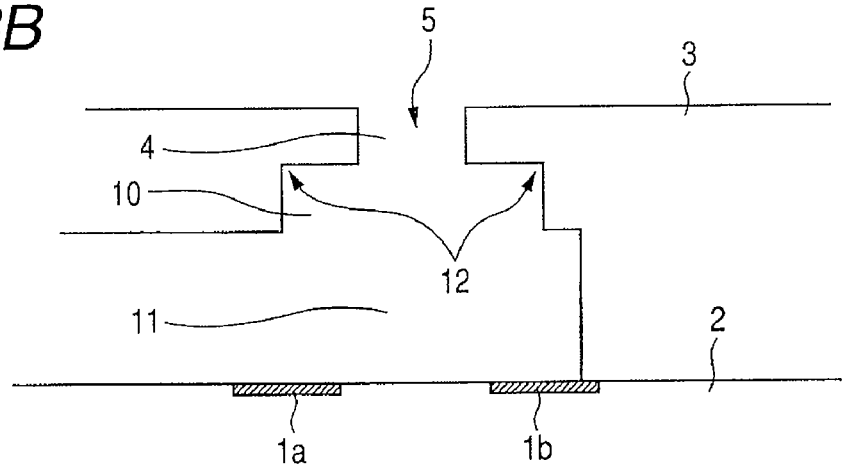
Figure 8C:
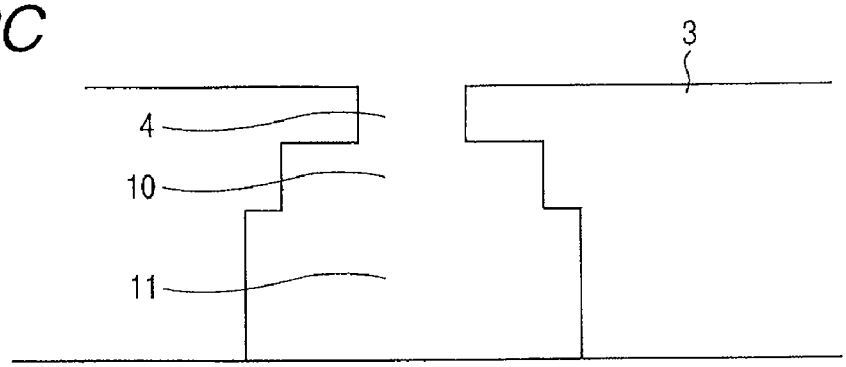

FIGS. 8A to 8C are views showing a nozzle structure of an ink jet recording head according to a fourth embodiment of the present invention. Here, FIG. 8A is a plan view of one of plural nozzles of the ink jet recording head, viewed from a direction perpendicular to a substrate, FIG. 8B is a sectional view taken along the line 8B-8B in FIG. 8A and FIG. 8C is a sectional view taken along the line 8C-8C in FIG. 8A.

As shown in FIGS. 8A to 8C, in this embodiment, ink supply paths 9*a* and 9*b* are communicated with the bubble generating chamber 11 at both sides of the bubble generating chamber, and the inks are supplied to the bubble generating chamber 11 from both ink supply paths. When observed in the plan view shown in FIG. 8A, each of two heaters 1*a* and 1*b* is arranged on the element substrate 2 in the vicinity of each of the ink supply paths 9*a* and 9*b* in such a manner that each heater straddles between the inner area within the second discharge port portion 10 and the outer area out of the second discharge port portion. Incidentally, when observed in the plan view shown in FIG. 8A, centers of the heaters 1*a* and 1*b* are positioned on an outer peripheral edge of the second discharge port portion 10.

Also in such an arrangement in which the ink supply paths 9*a* and 9*b* are communicated with both sides of the bubble generating chamber 11, each of two heaters 1*a* and 1*b* is positioned to straddle between the area within the second discharge port portion 10 and the outer area outside of the second discharge port portion. As a result, two bubbles simultaneously generated by the heaters 1*a* and 1*b* positively separate the inks in the ink supply paths 9*a* and 9*b* from the ink in the bubble generating chamber 11. Further, the bubbles push the ink toward the first discharge port portion 4 while pinching the ink therebetween, thereby discharging the ink droplet from the first discharge port portion 4.

Accordingly, also in this embodiment, similar to the first embodiment, the ink existing in the region of the second discharge port portion 10 where the ink may be stagnated is pushed out. Further, since the ink in the bubble generating chamber 11 is positively separated from the inks in the ink supply paths 9*a* and 9*b*, the satellite(s) and/or ink mist which may be generated after the main liquid droplet can be reduced. Particularly, as is in the illustrated embodiment, when the second discharge port portion 10 has a cylindrical shape perpendicular to the element substrate 2, the outer peripheral edge of the second discharge port portion 10 observed in the plan view shown in FIG. 8A is overlapped with corners 12 of the second discharge port portion shown in FIG. 8B. Although the ink is apt to be stagnated at the corners 12 in the second discharge port portion 10, by positioning the centers of the heaters just below the corners, the ink existing in the region of the second discharge port portion 10 where the ink may be stagnated can be pushed out more positively.

Incidentally, in such an arrangement, heaters 1*a* and 1*b* having a size capable of outputting the bubble generating energy sufficient to separate the inks in the ink supply ports 9*a* and 9*b* from the ink in the bubble generating chamber 11 positively are provided.

This application claims priority from Japanese Patent Application No. 2004-373886 filed Dec. 24, 2004, which is hereby incorporated by reference herein.

What is claimed is:

1. A liquid discharge head for discharging liquid, comprising:

an element substrate having a main surface on which a plurality of discharge energy generating elements for generating energy for discharging a liquid droplet are provided; and a flow path constituting substrate disposed on said main surface of said element substrate in order to constitute a bubble generating chamber having said plurality of discharge energy generating elements, a first discharge port portion for discharging the liquid droplet, a second discharge port portion for communicating said bubble generating chamber with said first discharge port portion, said second discharge port portion having a diameter greater than that of said first discharge port portion and a liquid supply path for supplying the liquid to said bubble generating chamber, wherein at least one of said discharge energy generating elements is disposed to straddle between an inner area of said second discharge port portion and an outer area outside of said second discharge port portion in a plan view viewed from a direction perpendicular to said main surface of said element substrate at a region where said bubble generating chamber is communicated with said liquid supply path.

2. A liquid discharge head according to claim 1, wherein, in the plan view viewed from the direction perpendicular to said main surface of said element substrate, said discharge energy generating element disposed to straddle between said inner area of said second discharge port portion and said outer area outside of said second discharge port portion has a length greater than a width of an opening portion of said liquid supply path at a bubble generating chamber side in a widthwise direction of said opening portion.

3. A liquid discharge head according to claim 1, wherein, in the plan view viewed from the direction perpendicular to said main surface of said element substrate, a center of at least one of said discharge energy generating elements is arranged on an outer peripheral edge of said second discharge port portion.

4. A liquid discharge head according to claim 1, wherein at least four of said discharge energy generating elements are provided for one bubble generating chamber.

5. A liquid discharge head according to claim 1, wherein, in the plan view viewed from the direction perpendicular to said main surface of said element substrate, said discharge energy generating element disposed to straddle between said inner area of said second discharge port portion and said outer area outside of said second discharge port portion has a bubble generating area greater than those of other discharge energy generating elements provided in the same bubble generating chamber.

* * * * *